US009513091B2

(12) United States Patent
Roberts

(10) Patent No.: US 9,513,091 B2
(45) Date of Patent: Dec. 6, 2016

(54) ROLLING TARGET

(71) Applicant: Daniel Roberts, Reno, NV (US)

(72) Inventor: Daniel Roberts, Reno, NV (US)

( * ) Notice: Subject to any disclaimer, the term of this patent is extended or adjusted under 35 U.S.C. 154(b) by 138 days.

(21) Appl. No.: 14/596,512

(22) Filed: Jan. 14, 2015

(65) Prior Publication Data

US 2015/0198426 A1 Jul. 16, 2015

Related U.S. Application Data

(60) Provisional application No. 61/927,357, filed on Jan. 14, 2014.

(51) Int. Cl.
*F41J 7/04* (2006.01)
*F41J 1/01* (2006.01)

(52) U.S. Cl.
CPC .... *F41J 7/04* (2013.01); *F41J 1/01* (2013.01)

(58) Field of Classification Search
CPC ..... A63B 69/00; F41J 5/00; F41J 5/14; F41J 7/04; F41J 1/01
USPC ..... 273/371, 390–410; 473/446
See application file for complete search history.

(56) References Cited

U.S. PATENT DOCUMENTS

| | | | | |
|---|---|---|---|---|
| 5,947,477 | A | 9/1999 | Turnipseed | |
| 7,175,181 | B1 | 2/2007 | Bateman et al. | |
| 7,427,069 | B2 | 9/2008 | Bateman et al. | |
| 7,661,679 | B2 * | 2/2010 | Mah et al. | 273/371 |
| 7,690,656 | B2 * | 4/2010 | Saunders | 273/392 |
| 7,815,192 | B1 * | 10/2010 | Kreiman et al. | 273/390 |
| 8,413,991 | B2 * | 4/2013 | Sudbeck et al. | 273/392 |
| 8,556,269 | B2 | 10/2013 | Berger et al. | |
| 2012/0274028 | A1 * | 11/2012 | Sudbeck et al. | 273/386 |
| 2013/0207347 | A1 | 8/2013 | Sovine | |

FOREIGN PATENT DOCUMENTS

WO 2009/038848 A2 3/2009

OTHER PUBLICATIONS

Jumping Jax—Walking Reactive Target Sytem-22cal Model Backpack Targets, http://www.ebay.com/itm/Jumping-Jax-Walking-Reactive-Target-Sytem-22cal-Model-Bac . . . , pp. 1-3, printed Sep. 24, 2015.

(Continued)

*Primary Examiner* — Gene Kim
*Assistant Examiner* — Jeffrey Vanderveen
(74) *Attorney, Agent, or Firm* — David R. Conklin; Kirton McConkie

(57) ABSTRACT

The present invention relates generally to a rolling target device. In particular, the present invention relates to a target comprising two L-shaped halves that are selectively joined together via complimentary slots, wherein the complementary slots comprise reinforcing buttresses that provide stability and increased rigidity to the arms of each L-shaped half. The buttresses of each L-shaped half further comprise one or more channels which are configured to receive a securement strap, such as a zip tie. When the complementary slots of the L-shaped halves are fully joined together, the one or more channels on each respective half are aligned, thereby providing a single, annular channel through which the securement strap may be inserted and secured. The present invention further includes a rolling target device comprising a lightweight polymer material that is self-healing.

12 Claims, 7 Drawing Sheets

(56) References Cited

OTHER PUBLICATIONS

Jumping Targets, http://jumpingtargets.com/collections/all, pp. 1-3, printed Sep. 24, 2015.
Walking/Rolling Steel Targets, http://kitup.military.com/2012/walkingrolling-steel-targets.html, pp. 1-4, printed Sep. 24, 2015.
Large Jumping Jack Plinking Target, http://www.rivercottagetables.com/ar_500_steel_targets_and_gun_accessories, pp. 1-8, printed Sep. 24, 2015.
Impact-22 22 LR & WMR Rolling Steel Target, http://www.rollingsteeltargets.com, pp. 1-3, printed Sep. 24, 2015.

* cited by examiner

ROLLING TARGET

RELATED APPLICATIONS

This application claims priority to U.S. Provisional Patent Application Ser. No. 61/927,357, filed Jan. 14, 2014 and titled ROLLING TARGET, which is incorporated herein in its entirety.

BACKGROUND OF THE INVENTION

The present invention relates generally to a rolling target device. In particular, the present invention relates to a target comprising two L-shaped halves that are selectively joined together via complimentary slots, wherein the complementary slots comprise reinforcing buttresses that provide stability and increased rigidity to the arms of each L-shaped half. The buttresses of each L-shaped half further comprise one or more channels which are configured to receive a securement strap. A securement strap may include any structure or form that is compatible for use in securing together each L-shaped half. Non-limiting examples of securement straps include zip ties, string, wire, rubber bands, adhesive tape, and the like. When the complementary slots of the L-shaped halves are fully joined together, the one or more channels on each respective half are aligned, thereby providing a single, annular channel through which the securement strap is inserted and secured. The present invention further includes a rolling target device comprising a lightweight polymer material that is self-healing.

A rolling target, also known as a "jumping jack" or "jumping target" is a 3-dimensional shooting target which includes a plurality of arms, each arm having a terminal end comprising a target surface, and each target surface being arranged in x, y, and z spatial quadrants. In some instances, the target surfaces in the y and z spatial quadrants provide a tri-point base for the target. When the target is at rest on the tri-point base, a single target surface is located or positioned in the x spatial quadrant. This single target surface is located at a height above the tri-point base, and is thereby presented as a shooting target to the shooter. When the single target surface is struck by a bullet, the force of the impact repositions the single target surface from the x spatial quadrant to either the y or z spatial quadrants, thereby causing one of the target surfaces in the y or z spatial quadrants to be relocated to the x spatial quadrant. In other words, the force of impact from the bullet causes the target device to roll, thereby repositioning the target surfaces of the device.

Rolling targets generally comprise metallic materials that may be welded and which are suitable for target shooting. For example, some rolling targets comprise ballistic grade steel, such as AR500. This material is selected for its increased hardness and its resistance to shattering. In some instances, rolling targets comprise identical L-shaped halves that are joined via complementary slots and then welded together to provide a permanent 3-dimensional structure. This method of joining is important to prevent movement and separation of the L-shaped halves during use of the target. Unfortunately, the permanent 3-dimensional volume of the target reduces portability and requires increased storage area for the device. The permanent 3-dimensional volume of the target structure also requires increased packaging materials and shelf space for displaying and selling the device.

Thus, while rolling targets currently exist, challenges still remain. Accordingly, there is a need for an improved rolling target. Such a device is disclosed herein.

BRIEF SUMMARY OF THE INVENTION

The present invention relates generally to a rolling target device. In particular, the present invention relates to a target comprising two L-shaped halves that are selectively joined together via complimentary slots, wherein the complementary slots comprise reinforcing buttresses that provide stability and increased rigidity to the arms of each L-shaped half. The buttresses of each L-shaped half further comprise one or more channels which are configured to receive a securement strap, such as a zip tie. When the complementary slots of the L-shaped halves are fully joined together, the one or more channels on each respective half are aligned, thereby providing a single, annular channel through with the securement strap is inserted and secured. In some embodiments, the buttresses of the L-shaped halves are provided without channels. The present invention further includes a rolling target device comprising a lightweight polymer material that is self-healing.

Some implementations of the present invention include a rolling target comprised on a lightweight, self-healing polymer material. The lightweight properties of the material contribute to the portability of the rolling target device. The lightweight properties further provide a target device that may be easily moved with lower caliber ammunition.

Some implementations of the present invention include a rolling target comprised of two L-shaped halves that are selectively and slidably joined together by intersecting partial slots located in the middles of the two halves. The partial slots form a keyed connection that positions the two halves in perpendicular planes.

In some instances, one or both of the halves comprise a buttress support that is located near the partial slot and configured to provide support and rigidity to the arms of each half. In other instances, the halves further comprise one or more channels through which is threaded a securement strap, such as a zip tie. When the two halves are fully joined together, the channels of the respective halves are aligned thereby forming a single annular channel through which the securement strap is inserted. The exposed ends of the securement strap are secured and cinched thereby maintaining the joined connection between the two halves.

BRIEF DESCRIPTION OF THE SEVERAL VIEWS OF THE DRAWINGS

In order that the above-recited and other features and advantages of the invention are obtained and will be readily understood, a more particular description of the invention briefly described above will be rendered by reference to specific embodiments thereof, which are illustrated in the appended drawings. These drawings depict only typical embodiments of the invention and are not therefore to be considered to limit the scope of the invention.

DETAILED DESCRIPTION OF THE INVENTION

The presently preferred embodiments of the described invention will be best understood by reference to the Figures, wherein like reference numbers indicate identical or functionally similar elements. It will be readily understood that the components of the present invention, as generally described and illustrated in the Figures, could be arranged and designed in a wide variety of different configurations. Thus, the following more detailed description, as represented in FIGS. 1 through 9, is not intended to limit the scope of the invention as claimed, but is merely representative of some presently preferred embodiments of the invention.

Figure 1:
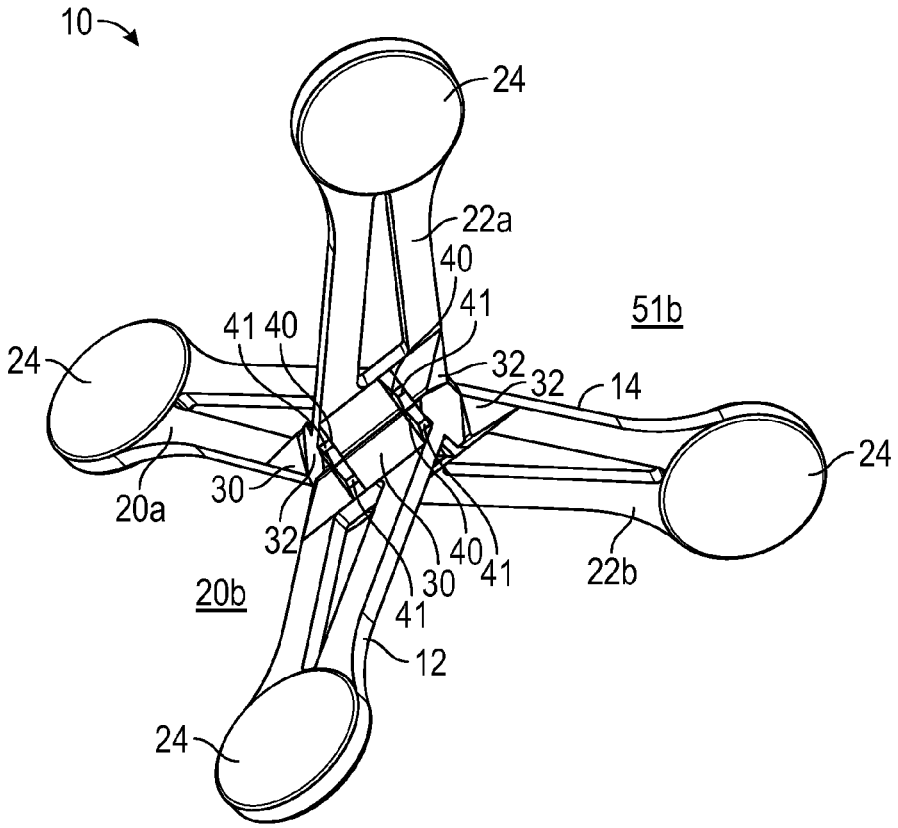
FIG. 1 is a perspective view of an assembled rolling target device in accordance with a representative embodiment of the present invention.
Figure 2:
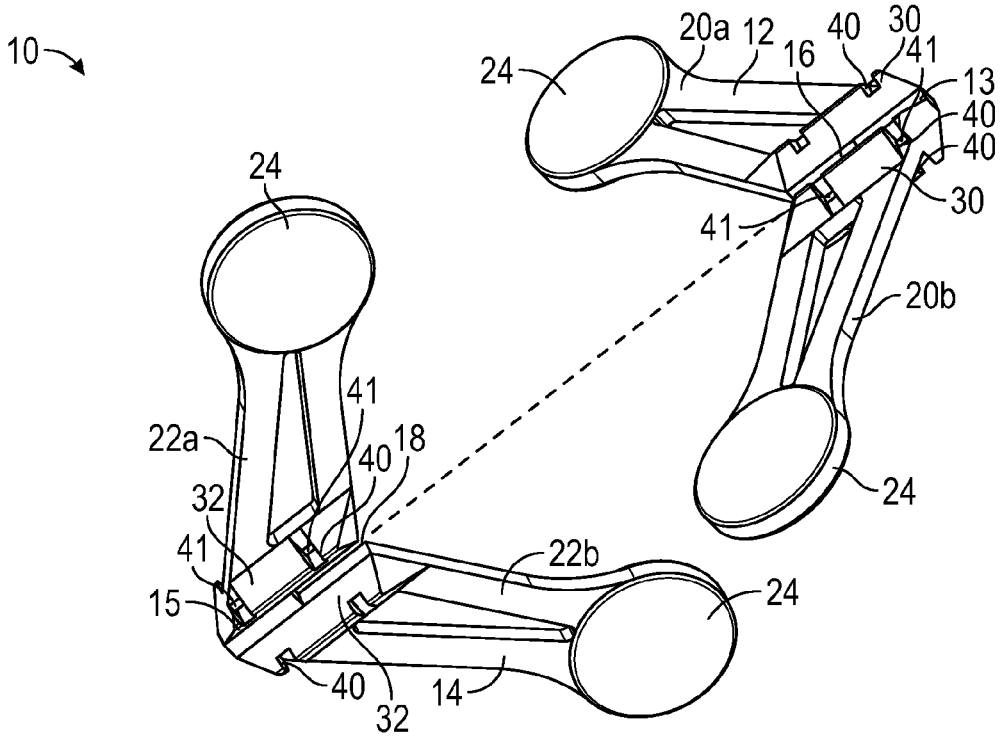
FIG. 2 is an exploded view of a rolling target device in accordance with a representative embodiment of the present invention.

Referring to FIGS. 1 and 2, a portable rolling target 10 is shown. Rolling target 10 comprises a lightweight, self-healing polymer material. In some instances, rolling target 10 comprises a smart material having the structurally incorporated ability to repair damage caused by bullets contacting and piercing the material. Examples of suitable polymer materials include polymer materials capable of at least one of hemolytic bond cleavage, heterolytic bond cleavage, reversible bond cleaving, and supramolecular breakdown. In other instances, rolling target 10 comprises a high density, compliable polymer material, such as poly(urea)urethane, polyurethane, or high-density polyethylene. In some instances, rolling target 10 comprises at least one of Surlyn®, Vistaion®, Luran®, Strulux®, Lustran®, Eastar®, Elvax®, Tone®, Flexomer®, and Affinity® materials. Upon being pierced by a bullet, the hole is closed and/or repaired, thereby extending the durability and longevity of the device.

The lightweight properties of the self-healing material also contribute the portability of rolling target 10. Unlike steel targets, rolling target 10 is lightweight and therefore ideal for transporting in a backpack. The lightweight material is further ideal for shipping and bulk storage.

Rolling target 10 comprises two L-shaped halves 12 and 14. In some embodiments, each half is identical. In other embodiments, either half may include one or more structures or features that are not included on the other half. Generally, halves 12 and 14 each comprise a middle 13 and 15, respectively, forming a symmetrical center. Each half further comprises a set of arms 20*a*, 20*b*, 22*a* and 22*b* which extend outwardly from their respective middles 16 and 18. Arms 20*a*-22*b* each further comprise a target surface 24.

Generally, target surfaces 24 are spaced approximately 109.5° apart. Thus, the spatial positions of the target surfaces in the assembled rolling target 10 define four triangular planes forming a tetrahedron shape. A base triangular plane is defined by the three target surfaces 24 that contact a surface on which the rolling target 10 is supported. The remaining target surface 24 is approximately normal to the base plane and is presented in an upward position as a shooting target for a shooter. When the remaining target surface 24 is struck by a bullet, the impact force of the bullet rearranges the positions of the target surfaces such that the remaining target surface 24 now becomes part of the base triangular plane and a new target surface is presented in the upward position. In other words, the impact of the bullet causes rolling target 10 to roll, thereby rearranging the spatial positions of the target surfaces 24.

Middles 13 and 15 further comprise slots 16 and 18, respectively. Slots 16 and 18 are configured to compatible receive one another in a slidable fashion. In some instances, slots 16 and 18 comprise partial slots, as shown. The remaining portions of middles 13 and 15 are thus fitted into the partial slot of the opposite half. In some instances, the connection interface between the two middles 13 and 15 provides a keyed fit. In some instances, the tolerances between slots 16 and 18, as well as middles 13 and 15 are selected to provide an interference fit.

Slots 16 and 18 are joined as halves 12 and 14 are oriented in perpendicular planes, the middles 13 and 15 are aligned, and partial slots 16 and 18 are slid together. Halves 12 and 14 are maximally joined together when the remaining portions of middles 13 and 15 contact one another, thus preventing any further sliding motion, or thus preventing any further coupling motion. Halves 12 and 14 are similarly disjoined by sliding the halves apart, as shown in FIG. 2.

Middles 13 and 15 further comprise one or more buttress supports 30 and 32, respectively. Buttress supports 30 and 32 are positioned proximate to partial slots 16 and 18 and comprises a thickened base portion of arms 20*a*-22*b*. In some instances, the compliant property of the self-healing material provides arms 20*a*-22*b* that are generally flexible in downward and upward directions, relative to the plane of the respective halves 12 and 14. Buttress supports 30 and 32 provide increased support and rigidity to their respective arms, thereby reducing the arms' flexibility. Buttress supports 30 and 32 further provide increased strength and rigidity to the intersection of middles 13 and 15.

Buttress supports 30 and 32 generally comprise surfaces that are configured to contact an opposing surface of the opposite half (12 or 14). In some instances, buttress support 30 comprises one or more interface surfaces that are configured to contact one or more interface surfaces of buttress support 32, as shown in FIGS. 1-4, and 7-9. In other instances, buttress support 30 comprises one or more interface surfaces that are configured to contact one or more surfaces of arms 52*a*-52*d*, as shown in FIGS. 5A-5C and 6.

In some instances, halves 12 and 14 further comprise one or more channels 40 through which may be inserted or threaded a securement strap 80, such as a zip tie. In some instances, halves 12 and 14 are provided without channels. In some instances, channels 40 are provided through buttress supports 30 and/or 32. In other instances, channels 40 provide a pathway or window 41 through one or more arms 20*a*-22*b*. When partial slots 16 and 18 of halves 12 and 14 are maximally slid together, channels 40 are aligned annularly, thereby providing a common annular channel between halves 12 and 14. In some instances, halves 12 and 14 comprise a plurality of channels 40, wherein when halves 12 and 14 are maximally slid together, the plurality of channels 40 provide two or more common annular channels between halves 12 and 14. In some instances, channels 40 of halves 12 and 14 further comprise a plurality of windows 41, wherein when halves 12 and 14 are maximally slid together, opposing windows 41 are aligned, whereby a securement strap 80 may be threaded through the aligned windows 41 to secure together the two interconnected halves 12 and 14.

Figure 3A:
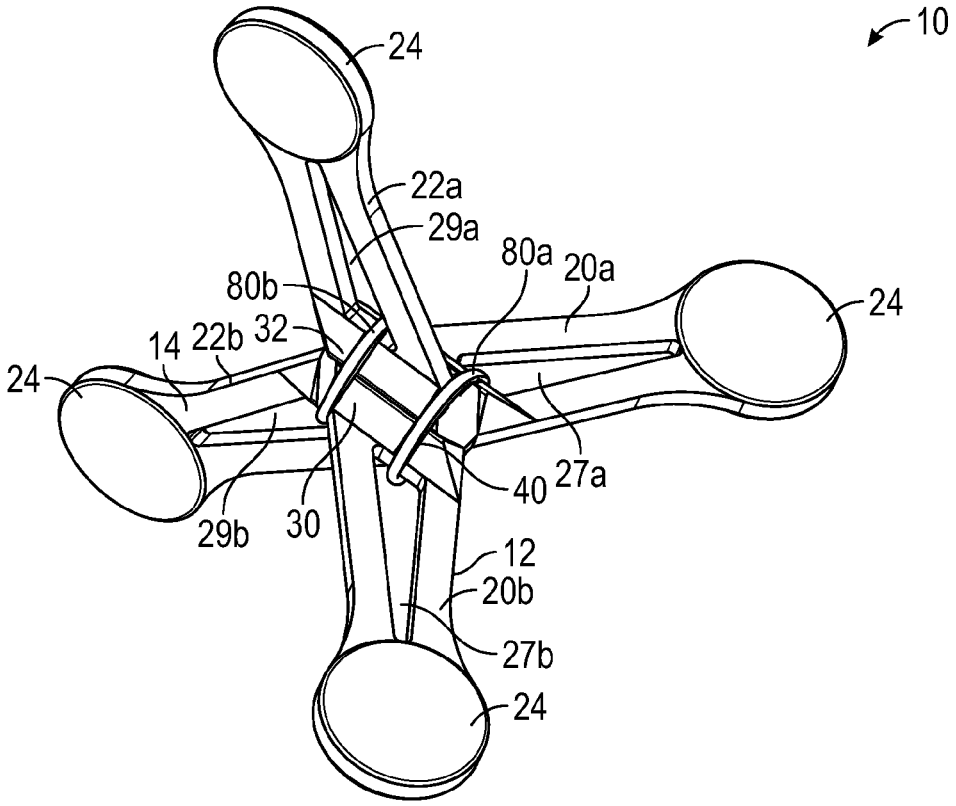
FIG. 3A is a perspective view of an assembled rolling target having securement straps in accordance with a representative embodiment of the present invention.

Referring now to FIG. 3A, in some embodiments arms 20*a*-22*b* further comprise cutouts 27*a*, 27*b*, 29*a* and 29*b*. Cutouts 27*a*-29*b* remove additional material from halves 12 and 14, thereby further decreasing the weight of rolling target device 10. Cutouts 27*a*-29*b* may further reduce the rigidity of arms 20*a*-22*b*, thereby providing increased flexibility and motility to arms 20*a*-22*b* and target surfaces 24.

Cutouts 27*a*-29*b* further provide a pathway through which securement straps 80*a* and 80*b* may be routed to secure the joined halves, according to some embodiments. In some embodiments, halves 12 and 14 further comprise forward and rearward channels 40*a* and 40*b* that are aligned when the halves are joined together. Once aligned, channels 40*a* and 40*b* of both halves form forward and rearward annular channels. A forward securement strap 80*a* is placed into the forward annular channel formed by the aligned forward channels 40*a*. Securement strap 80*a* passes through cutouts 29*a* and 29*b* of L-shaped half 14, further intersecting forward channels 40*a* of halves 12 and 14. Similarly, securement strap 80*b* passes through cutouts 27*a* and 27*b* of L-shaped half 12, further intersecting rearward channels 40*b* of halves 12 and 14. Securement straps 80*a* and 80*b* are cinched to securely retain the joined connection between the two halves 12 and 14.

Figure 3B:
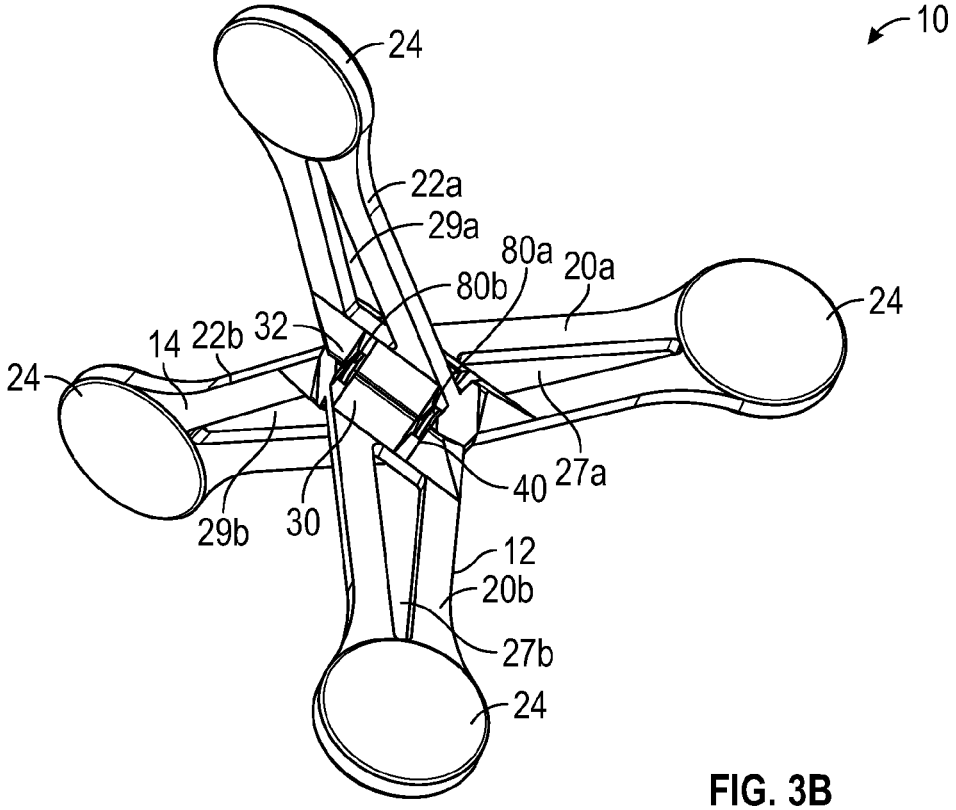
FIG. 3B is a perspective view of an assembled rolling target having securement straps threaded through a plurality of windows located within channels in accordance with a representative embodiment of the present invention.
Figure 4:
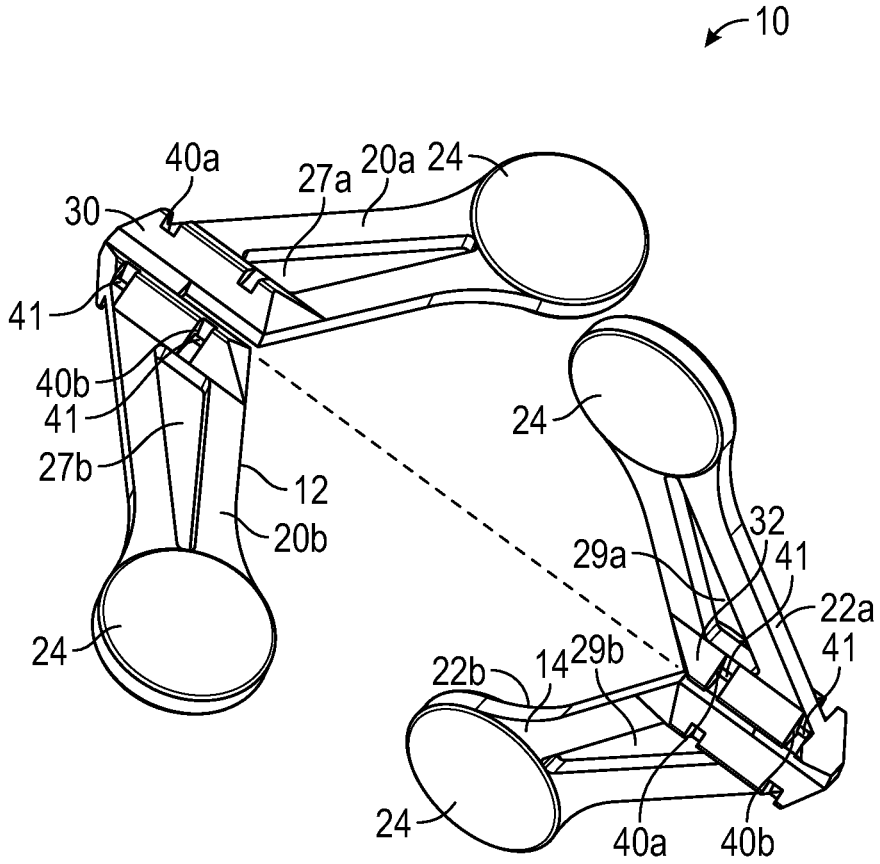
FIG. 4 is an exploded view of the rolling target of FIG. 3B.
Figure 5A:
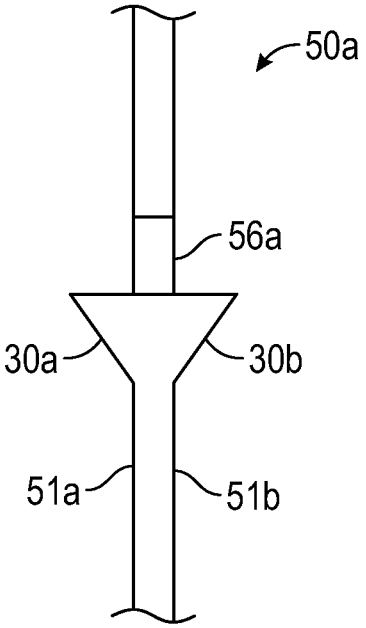
FIGS. 5A, 5B and 5C each show plan front views of L-shaped halves that are or may be joined together to provide a rolling target device in accordance with a representative embodiment of the present invention.
Figure 5B:
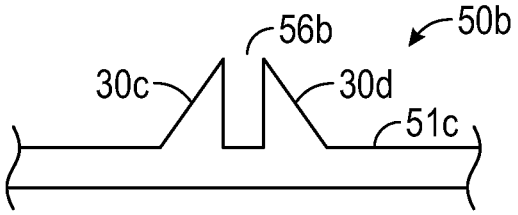
Figure 5C:
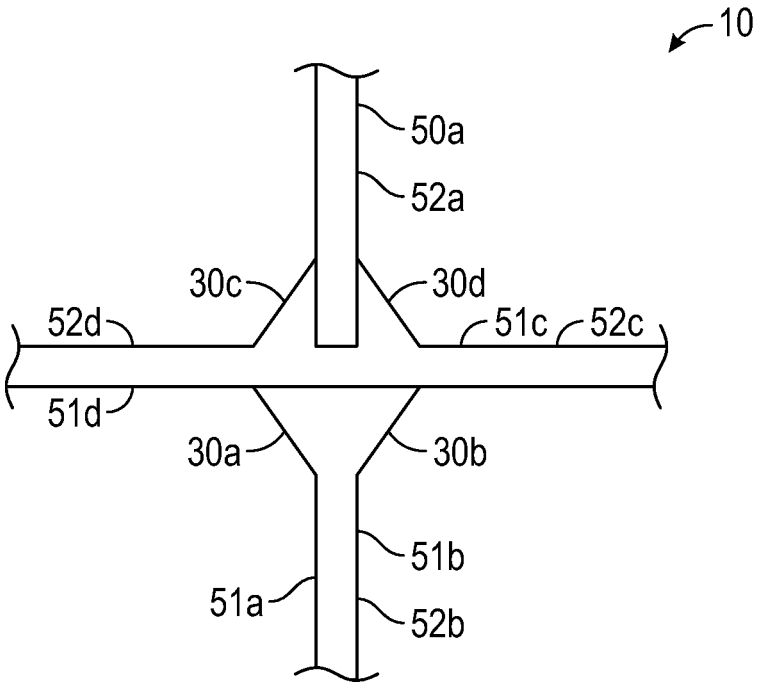

Referring now to FIGS. 3B and 4, in some embodiments channels 40 (also shown as 40*a* and 40*b*) further comprise windows 41 which are located at the base of arms 20*a*-22*b* and proximate to middles 13 and 15. When halves 12 and 14 are maximally joined together, windows 41 of their respective arms 20*a*-22*b* are aligned, as are channels 40. An annular pathway is provided through the aligned windows. In some instances, securement straps 80*a* and 80*b* are threaded through the aligned windows and synched, as shown in FIG. 3B. Unlike the embodiment shown in FIG. 3A, the location of securements straps 80*a* and 80*b* in FIG. 3B are entirely positioned within channels, and are therefore protected by their placement. Upon removal of securement straps 80*a* and 80*b*, halves 12 and 14 may be separated, as shown in FIG. 4.

The number and positions of support buttresses may be configured in any manner that provides support and rigidity to the arms of the joined halves. For example, referring now to FIGS. 5A-5C, in some embodiments a first half 50*a* is provide having a first buttress support 30*a* located on a top planar surface 51*a*, and a second buttress support 30*b* located on a bottom planar surface 51*b*, wherein the first and second buttress supports 30*a* and 30*b* are located on the proximal side of partial slot 56*a*. A second half 50*b* is further provided having third and fourth buttress supports 30*c* and 30*d* located on a top planar surface 51*c*, wherein the third and fourth buttress supports 30*c* and 30*d* are positioned on proximal and distal sides of partial slot 56*b*. When partial slots 56*a* and 56*b* are slidably joined, buttress supports 30*c* and 30*d* provide support and rigidity to arm 52*a* of half 50*a*. Buttress supports 30*c* and 30*d* further provide support and rigidity to arms 52*c* and 52*d* of half 50*b*. Buttress supports 30*a* and 30*b* provide support and rigidity to arms 52*c* and 52*d*, as well as arm 52*b*.

Figure 6:
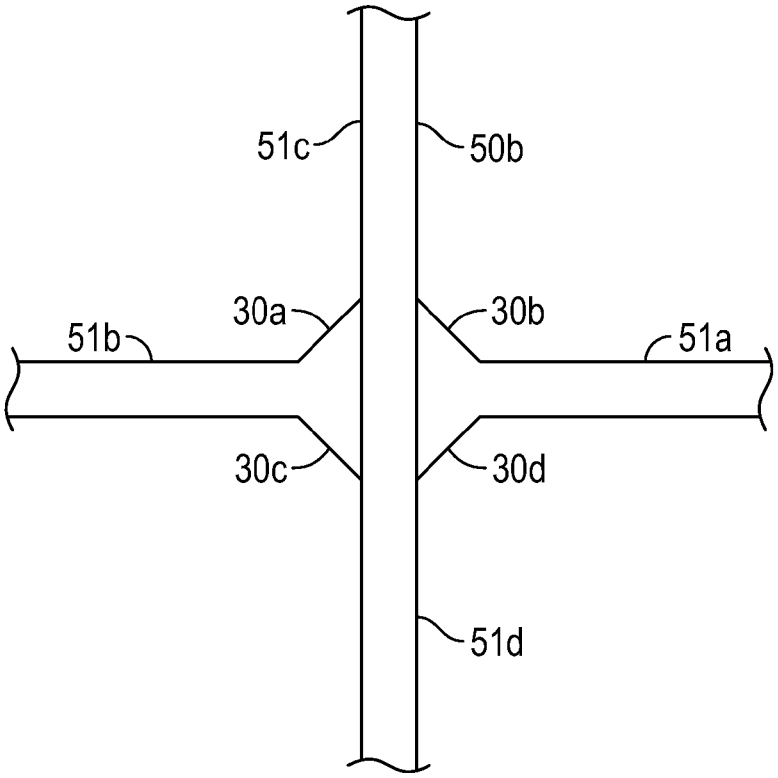
FIG. 6 is a side plan view of an L-shaped half comprising a full set of buttresses and further includes a second L-shaped half that does not include any buttresses, wherein the two L-shaped halves are joined together, and wherein the full set of buttresses provides rigidity to the arms of the first and second L-shaped halves in accordance with a representative embodiment of the present invention.

With reference to FIG. 6, in some embodiments half 50*a* comprises four buttress supports 30*a*-30*d*, while half 50*b* does not comprise any buttress supports. Thus, buttress supports 30*a*-30*d* provide support and rigidity to arms 51*a* and 51*b* of half 50*a*, as well as arms 51*c* and 51*d* of half 50*b*.

Figure 7A:
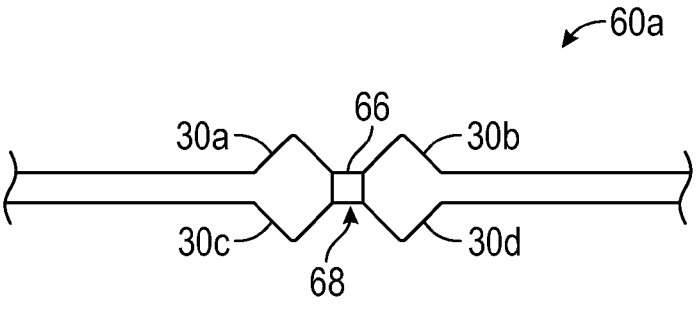
FIGS. 7A, 7B and 7C each show plan front views of L-shaped halves that are or may be joined together to provide a rolling target device in accordance with a representative embodiment of the present invention.
Figure 7B:
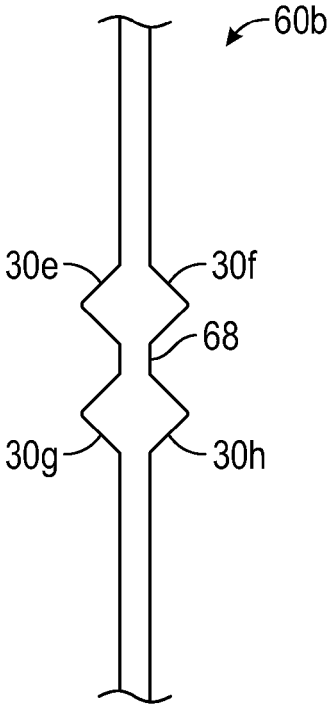
Figure 7C:
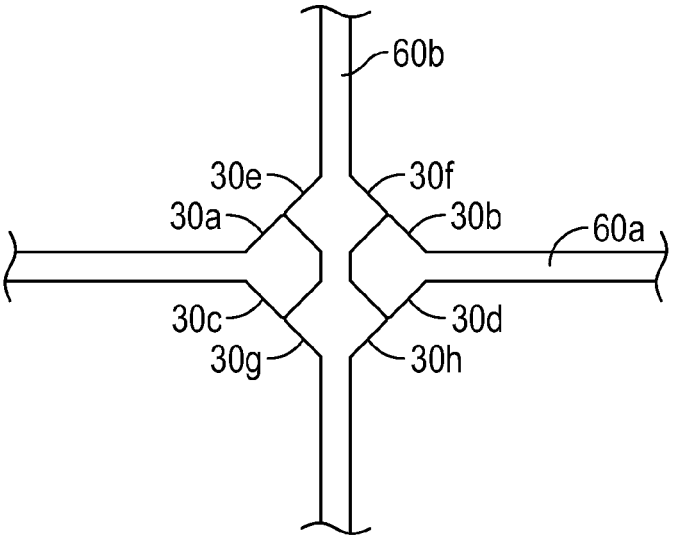

Referring now to FIGS. 7A-7C, in some embodiments rolling target 10 comprises two identical halves 60*a* and 60*b*, each half having a middle 68 comprising a partial slot 66. Each half 60*a* and 60*b* further comprises four quarter buttress support 30*a*-30*d* and 30*e*-30*h*, respectively positioned on each half's top and bottom planar surfaces, and in proximity to partial slot 66. When the partial slots 66 of the respective halves 60*a* and 60*b* are slidably joined, the eight quarter buttress supports 30*a*-30*h* are combined to provide complete buttress supports, thereby providing support and rigidity to the arms of halves 60*a* and 60*b*.

Figure 8:
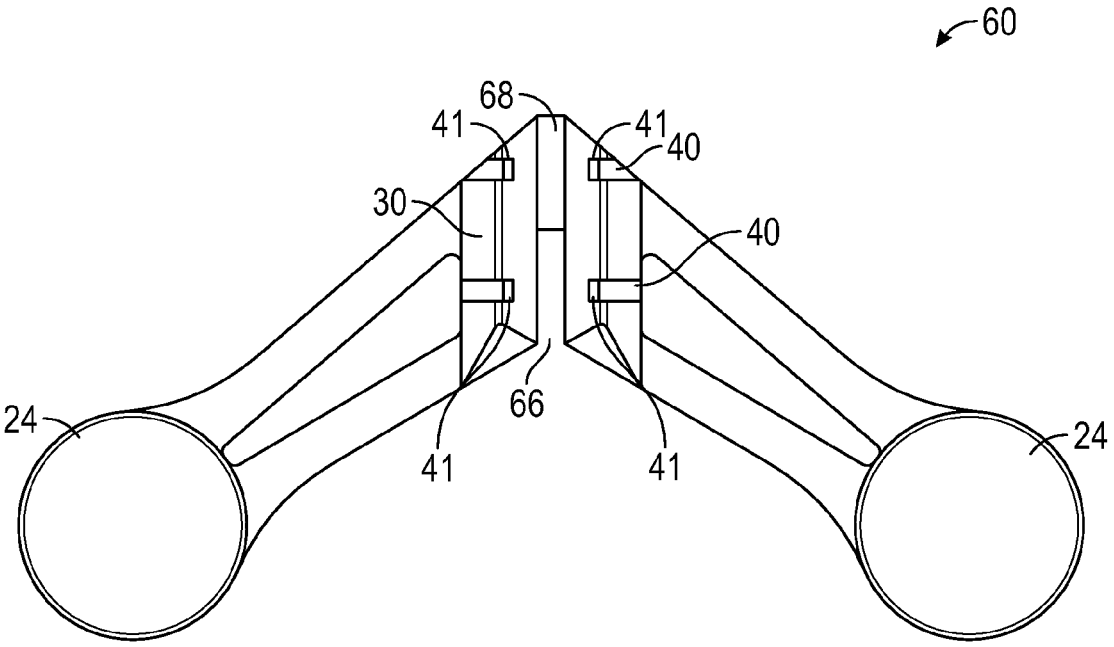
FIG. 8 is a top plan view of an L-shaped half comprising quarter support buttresses and channels in accordance with a representative embodiment of the present invention.
Figure 9:
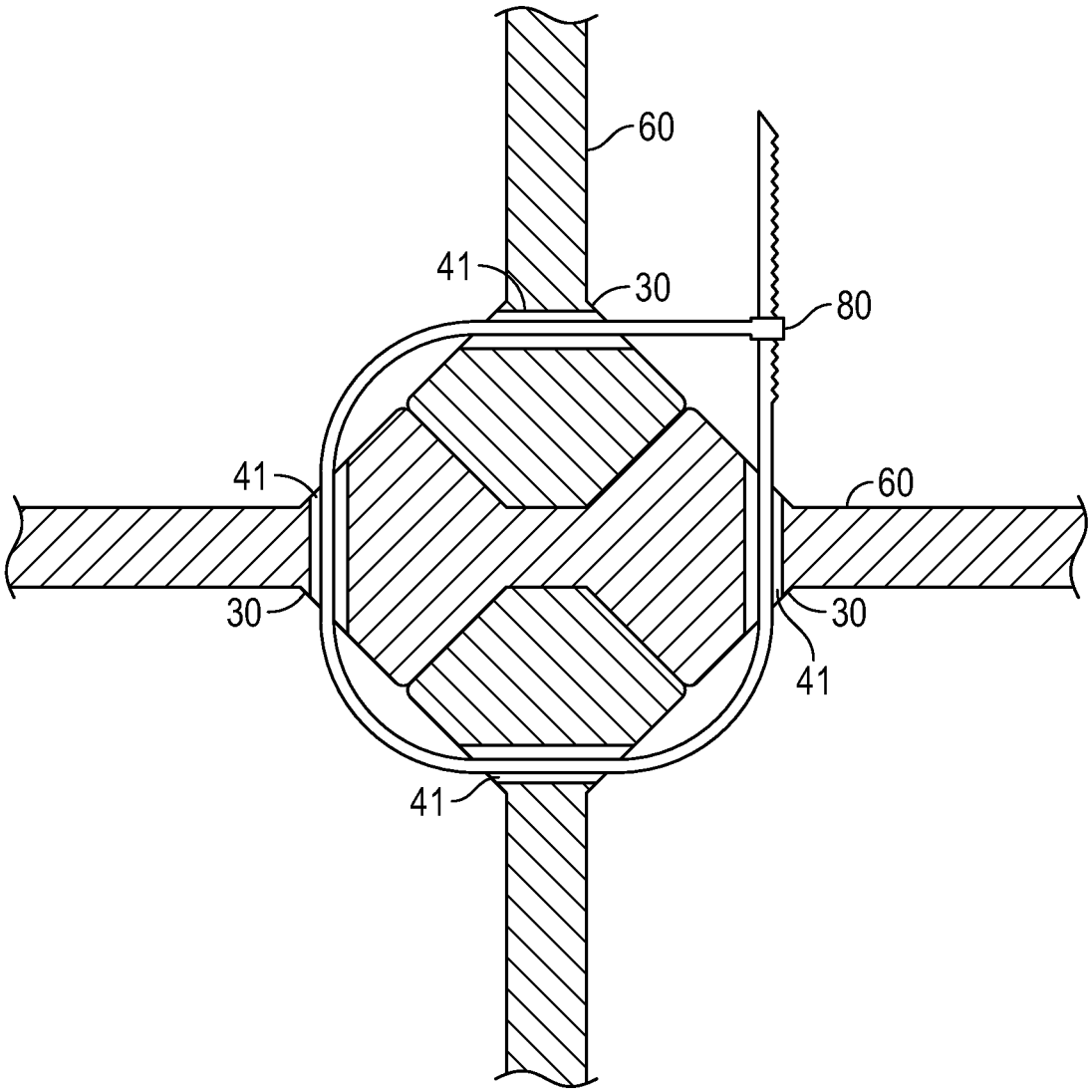
FIG. 9 is a cross-section view of the assembled rolling target of FIG. 6 and shows a single, annular channel through which a securement strap is inserted and secured.

In some embodiments, quarter buttress supports 30 further comprise one or more channels 40 configured to receive a securement strap, as shown in FIG. 8. Channels 40 are generally positioned to provide a common annular channel between the interfacing surfaces of the buttress supports 30 when the first and second halves are joined. In some embodiments, channels 40 further comprise a plurality of windows 41 which provide a pathway through a portion of the arm of each half. In this way the securement strap 80 is threaded through the window 41 in each arm as it is threaded through the aligned channels 40, as shown in FIG. 9. Once securement strap 80 has been threaded through the aligned channels 40 and windows 41, the free ends of securement strap 80 are secured and cinched. In other embodiments, channels 40 are positioned such that the securement strap may be secured within the aligned channels 40 without the use of windows 41.

Some embodiments of the present invention do not include channels 40, but rather rely on mechanical interference, or friction fit to maintain the connection between the two halves. In some instances, the friction coefficient of the self-healing polymer is sufficient to withstand the impact forces experienced during use without undergoing unintended separation of the two halves. In some embodiments, the partial slots further include one or more features to increase friction or mechanical interference between the joined halves. For example, in some instances the partial slots are tapered. In other instances a depression is provided in one slot and a corresponding ridge or bump is provided in the opposite slot. In other embodiments one or more interfacing surfaces of the partial slots is textured. One having skill in the art will appreciate that mechanical interference or friction may be increased by any number of known methods. Accordingly, it is understood that each of these methods may be implemented in the present invention, and therefore are considered viable alternative embodiments of the present invention.

The present invention may be embodied in other specific forms without departing from its structures, methods, or other essential characteristics as broadly described herein and claimed hereinafter. The described embodiments are to be considered in all respects only as illustrative, and not restrictive. The scope of the invention is, therefore, indicated by the appended claims, rather than by the foregoing description. All changes that come within the meaning and range of equivalency of the claims are to be embraced within their scope.

The invention claimed is:

1. A rolling target device, comprising:

a first L-shaped half comprising a middle having a partial slot, the first L-shaped half further comprising first and second arms having a planar surface, each arm having a terminal end comprising a target surface, the middle of the first L-shaped half further comprising a first buttress support and a second buttress support, the first and second buttress supports each having a first surface that tapers outwardly from the partial slot to an outermost point, and further having a second surface that tapers inwardly from the outermost point to the planar surface of the first and second arm, and further comprising a first channel; and a second L-shaped half comprising a middle having a partial slot, the second L-shaped half comprising third and fourth arms having a planar surface, each arm having a terminal end comprising a target surface, the middle of the second L-shaped half further comprising a third buttress support and a fourth buttress support, the third and fourth buttress supports each having a first surface that tapers outwardly from the partial slot of the second L-shaped half to an outermost point, and further having a second surface that tapers inwardly from the outermost point to the planar surface of the third and fourth arms, and further comprising a second channel, wherein the partial slot of the second L-shaped half is configured receive the partial slot of the first L-shaped half, thereby aligning the first and second channels to provide an annular channel through which a securement strap may be secured, and further aligning the first surfaces and the outermost points of the first, second, third and fourth buttress supports.

2. The device of claim 1, wherein the first L-shaped half further comprises a third channel, and the second L-shaped half further comprises a fourth channel, wherein when the first and second L-shaped halves are maximally joined together, the first and second channels are annularly aligned and the third and fourth channels are annularly aligned.

3. The device of claim 1, further comprising a plurality of windows located within the first and second channels, the plurality of windows providing a pathway though the middles of the first and second L-shaped halves, wherein the plurality of windows of the first and second channels are aligned when the first and second halves are maximally joined together, the plurality of windows providing an annular pathway through the middles of the first and second L-shaped halves.

4. The device of claim 3, wherein the plurality of windows are annularly aligned when the first and second channels are aligned.

5. The device of claim 1, wherein the first and second L-shaped halves are selectively joined together.

6. The device of claim 1, wherein the first and second L-shaped halves are slidably joined together.

7. The device of claim 1, wherein the first and second L-shaped halves comprise a self-healing polymer material.

8. The device of claim 1, wherein the first and second arms of each L-shaped half further comprises a cutout.

9. The device of claim 8, further comprising a securement strap.

10. The device of claim 9, wherein the securement strap is configured to insert within at least one of the first and second channels.

11. The device of claim 1, wherein the first surface of the first and second buttress supports contact the first surface of the third and fourth buttress supports when the first and second L-shaped halves are maximally joined.

12. The device of claim 9, wherein the securement strap is threadedly inserted through the cutouts of the first and second, arms of each L-shaped half in an annular configuration.

* * * * *